US007886385B2

(12) United States Patent
Carlitz

(10) Patent No.: US 7,886,385 B2
(45) Date of Patent: Feb. 15, 2011

(54) MATTRESS WITH QUILTED ZONED TOPPER

(75) Inventor: Stuart Scott Carlitz, New Hope, PA (US)

(73) Assignee: Eclipse International, Wilmington, DE (US)

( * ) Notice: Subject to any disclaimer, the term of this patent is extended or adjusted under 35 U.S.C. 154(b) by 79 days.

(21) Appl. No.: 12/468,113

(22) Filed: May 19, 2009

(65) Prior Publication Data

US 2010/0293717 A1 Nov. 25, 2010

(51) Int. Cl.
*A47C 27/05* (2006.01)
*A47C 31/02* (2006.01)
*A47G 9/02* (2006.01)

(52) U.S. Cl. ..... 5/691; 5/721; 5/737; 5/500

(58) Field of Classification Search ..... 5/691, 5/690, 716, 721, 731, 736, 737, 500
See application file for complete search history.

(56) References Cited

U.S. PATENT DOCUMENTS 4,042,986 A 8/1977 Goodman et al.
4,424,600 A 1/1984 Callaway
5,161,271 A * 11/1992 Gronbach ..... 5/668
5,172,441 A * 12/1992 Mayen ..... 5/669
5,285,542 A * 2/1994 West et al. ..... 5/500
5,319,814 A 6/1994 Dyer, Jr.
5,367,727 A * 11/1994 Dyer, Jr. ..... 5/678
5,475,881 A * 12/1995 Higgins et al. ..... 5/737
5,488,746 A 2/1996 Hudson
5,523,144 A 6/1996 Dyer, Jr.
5,655,241 A * 8/1997 Higgins et al. ..... 5/737
6,023,803 A 2/2000 Barman
2002/0112292 A1 * 8/2002 O'Brien ..... 5/727
2003/0093864 A1 5/2003 Visser et al.
2005/0097676 A1 5/2005 Rensink

OTHER PUBLICATIONS

International Search Report and Written Opinion dated Feb. 2, 2010 pertaining to International application No. PCT/US2009/062945.

* cited by examiner

*Primary Examiner*—Robert G Santos
(74) *Attorney, Agent, or Firm*—Dinsmore & Shohl LLP

(57) ABSTRACT

A quilted zoned topper formed with a quilted panel and a memory foam is disclosed. The quilted panel has a ticking material, a backing material, and a support material having a degree of compression provided between the ticking and backing materials. The ticking material, the support material and the backing material all are quilted together by a stitching pattern providing an increased amount of stitching in a center section of the quilted panel than adjacent head and foot sections of the quilted panel such that the support material pre-compresses in the center section thereby defining a pocket. The memory foam is provided in the pocket. A mattress provided with the quilted zoned topper is also disclosed.

20 Claims, 2 Drawing Sheets

MATTRESS WITH QUILTED ZONED TOPPER

FIELD OF THE INVENTION

The present invention relates to structures and materials and manufacturing methods for quilted bedding products, and particularly for a mattress with a quilted zoned topper.

BACKGROUND OF THE INVENTION

Some mattress technologies provide somewhat uniform support using a combination of inner springs and one or more foam layers provided under a mattress cover. However, uniform support presents a problem, because the weight distribution of the human body is not at all uniform. In fact, the lumbar region is where approximately 70 percent of the body weight of a sleeper lies. Although weight distribution of a sleeper is, of course, different from person to person, for a large majority, a sleeper's hips or buttocks will tend to sink excessively far into such mattresses as the foam layers breakdown from normal use over time. This problem is exacerbated when the mattress is used by two persons sleeping together.

This deficiency in support will tend to reduce the sleeper's comfort, to a greater or lesser degree depending on the person. However, a more important effect is that this deficiency in support may permit a person to sleep in a condition of postural misalignment. Spinal alignment, in a good sleeping posture, should be the same as that in a good standing posture. Thus a sleeper should be supported so that his or her spine will be laterally straight, and will be curved with no more (and no less) than normal lumber and thoracic arch and pelvic tilt. Distortions of this sleeping posture will produce immediate or gradual discomfort, and may also lead to backaches, or to vague discomforts which reduce the sleeper's overall level of health and well-being.

SUMMARY OF THE INVENTION

The present invention overcomes these and other disadvantages of the prior art by providing an improved bedding structure, in which added lumbar support is provided under a quilted zoned topper that is used in making a mattress cover. This innovative structure provides advantages of better postural support, and/or reduced manufacturing costs, and/or better in -service durability, and/or extra thermal insulation and padding and/or better comfort. This invention provides a method of offering variable support over the surface of a mattress by a simpler and therefore less expensive means.

In one embodiment, a quilted zoned topper is disclosed, and comprises a quilted panel having a ticking material, a backing material, and a support material having a degree of compression provided between the ticking and backing materials. The ticking material, the support material and the backing material all are quilted together by a stitching pattern providing an increased amount of stitching in a center section of the quilted panel than adjacent head and foot sections of the quilted panel such that the support material pre-compresses in the center section thereby defining a pocket. A memory foam is provided in the pocket.

In another embodiment, a mattress is disclosed. The mattress comprises an innerspring assembly having a plurality of spring elements and defining a support surface, at least one convoluted foam layer positioned over the support surface of the innerspring assembly, and a memory foam layer positioned over the convoluted foam layer opposite to the support surface. The memory foam layer has a density greater than the convoluted foam layer. The mattress further comprises a quilted panel having a ticking material, a backing material, and a support material having a degree of compression provided between the ticking and backing materials. The ticking material, the support material and the backing material all are quilted together by a stitching pattern providing an increased amount of stitching in a center section of the quilted panel than adjacent head and foot sections of the quilted panel such that the support material pre-compresses in the center section thereby defining a pocket. The quilted panel is provided over the convoluted and memory foam layers such that the memory foam layer is provided in the pocket.

These and other aspects of the invention are described herein in particularized detail with reference to the accompanying Figures, wherein like reference numerals refer to like parts.

DETAILED DESCRIPTION

The numerous innovative teachings of the present application will be described with particular reference to the presently preferred embodiment. However, it should be understood that this class of embodiments provides only a few examples of the many advantageous uses of the innovative teachings herein. In general, statements made in the specification of the present application do not necessarily delimit any of the various claimed inventions. Moreover, some statements may apply to some inventive features but not to others.

Figure 1:
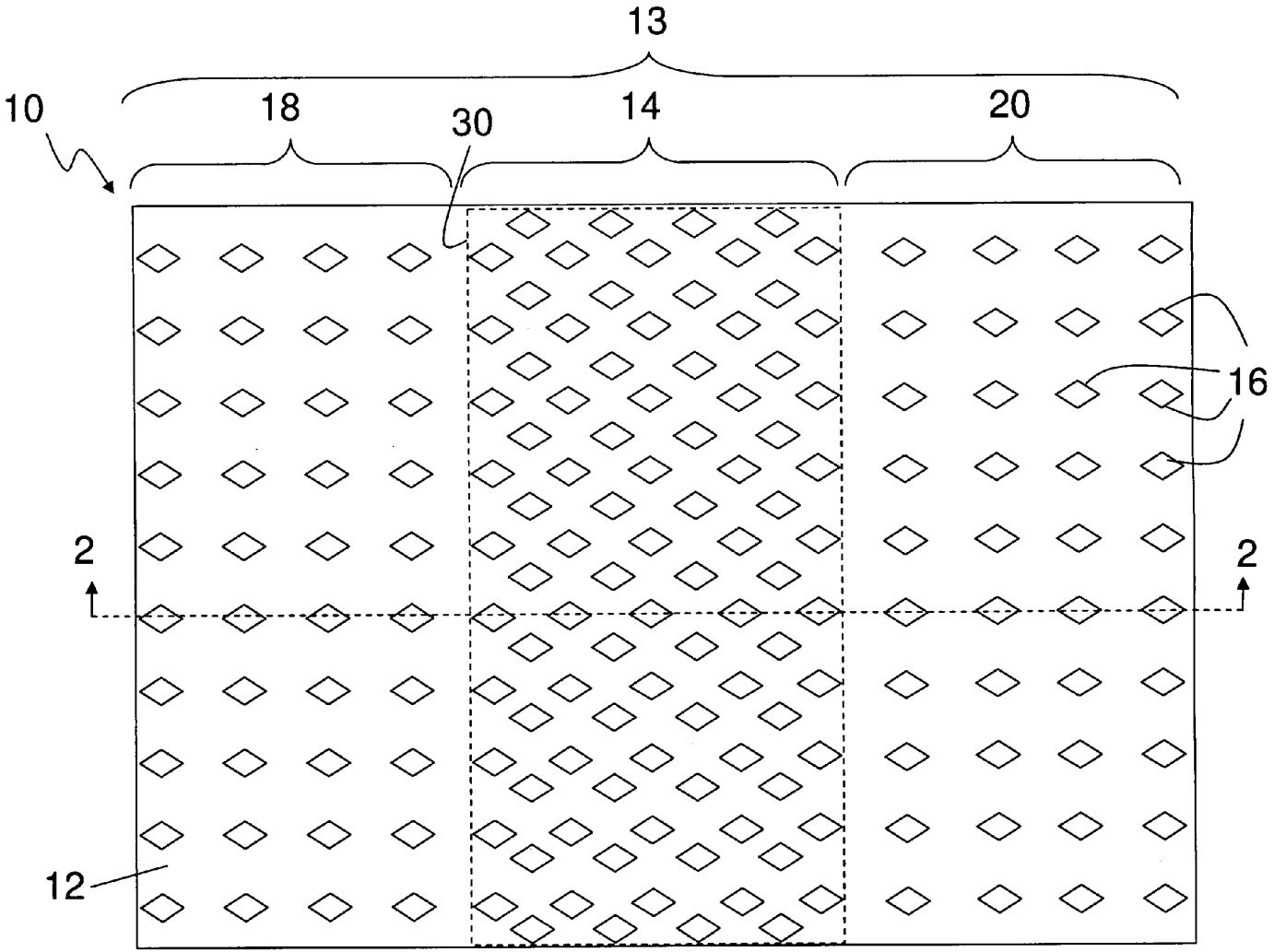
FIG. 1 is a top view schematically showing shape and typical dimensions of a mattress with a quilted zoned topper according to the present invention.

FIG. 1 is a top view schematically showing shape and typical dimensions of a mattress 10 with a mattress quilt panel 12 having a stitching pattern 13 according to the present invention. As shown, the stitching pattern 13 provides a center section 14 of the quilt panel 12 that has at least 2 times the amount of pattern stitching 16 then adjacent head and foot sections 18, 20. In one embodiment, the center section 14 represents approximately ⅓ of the mattress 10. In other embodiment, the center section 14 may range in size from about ¼ to about ½ of the mattress. In other words, the center section 14 can range in size from about ¼ to about ½ of the total area of the quilt panel 12 in top view. In the illustrated embodiment, the pattern stitching 16 is provided in a star pattern (e.g., 2.85"×2.85") with a six inch jump between patterns, but in other embodiments may be any other pattern, such as for example, a circle pattern (e.g., 1.6"×1.6"), a swoop pattern (e.g., 3"×2"), with other jumps ranging from 3 to 9 inches depending on desired comfort. In still other embodiments, the pattern stitching 16 may be a ribbon pattern (e.g., 6"×3"), a 213 pattern (e.g., 6"×3"), or a 301 pattern (e.g., 12"×6", or 6"×3"). It is to be appreciated that a smaller jump spacing will tend to provide firmer support, and wider spacings will provide a softer, more plush surface. The overall dimensions of the mattress 10 may be any standard mattress size, e.g., Twin, Full, Queen, King, and California King.

Figure 2:
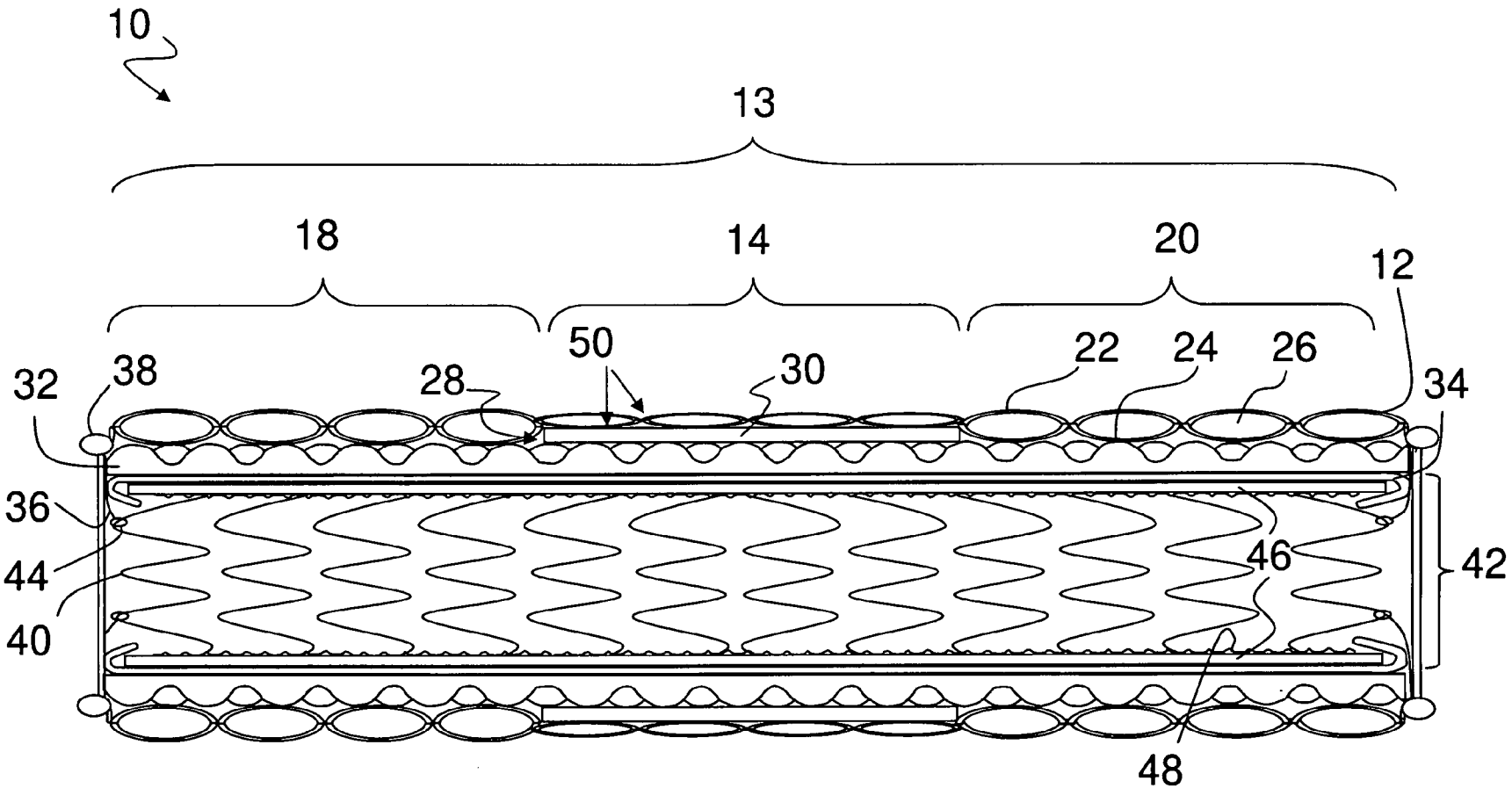
FIG. 2 is a sectional view of the mattress of FIG. 1 taken along section line 2-2 showing the construction of the quilted zone topper.

With reference to the FIG. 2, the mattress 10 is shown in cross-section. The quilt panel 12 is formed from a sheet of upholstery ticking 22 stitched to a backing layer 24 along with a support material 26, such as a relatively thin and less dense foam or fill layer provided therebetween. To stitch the quilt panel, the materials 22, 24, and 26 are fed into a conventional quilting machine, such as for example, a GI-4300-WCS class III computer driven double lock chain stitch quilter, made by Gribetz International, Inc., Sunrise, Fla. In one embodiment, the stitching is a top thread, such as for example, a 3-ply, 150 denier polyester, 475 total denier, and a bottom thread, such as a 2-ply, 150 denier polyester, 340 total denier, stitched with a needle having a #24 gauge with a stitch size of 6-9 per inch. In other embodiments, other thread types, gauges, and stitch sizes may be used. In one embodiment, the ticking 22 may be 100-150 end Damask, and the backing layer 24 a non-woven fabric, e.g. Accord™ or Vantex™ of 0.5 to 1.5 ounce weight, and combinations thereof. In one embodiment, support material 26 is a polymer foam or fill layer, and in other embodiments may be any foam or fill layer that compresses when stitched to provide the quilted zoned pattern according to the present invention. Once the quilting has been done, the resulting quilted material is fed into a panel cutting machine, such as the OCS-90, by Gribetz, where panels of appropriate lengths (widths of finished products) are cut. The resulting quilt panels 12 may then be used in the manufacture of mattresses, such as for example, innerspring mattresses.

As shown in FIG. 2, stitching the quilt panel 12 in the stitching pattern 13 results in the center section 14 having a narrower cross section than the head and foot sections 18, 20 with the same quilt fill provided by foam or fill layer 26. It is to be appreciated that providing the center section 14 of the quilt panel 12 with at least 2 times the amount of pattern stitching 16 then in the adjacent head and foot sections 18, 20, the support material 26 is pre-compressed in the center section 14 to a greater degree than in the adjacent sections 18, 20, thereby forming a pocket 28. Within this formed pocket 28, directly adjacent and under the center section 14 of the quilt panel 12, a high density foam layer 30 is provided. The high density foam layer 30 is sized and shaped to fill the pocket 28 in order to make the upholstery ticking 22 in the center section 14 the same level in height as in the head and foot sections 18, 20 to provide a level sleep surface.

As shown in FIG. 1, the high density foam layer 30, indicated in dashed lines, extends across the entire width of the mattress 10. In one embodiment, the high density foam layer 30 is a memory foam (i.e., polyurethane foam) with a density in the approximate range of 1.8 to 4.0 pounds per cubic foot, and in one preferred embodiment, 3 pounds per cubic foot. In one embodiment, the high density foam layer 30 has an indentation load deflection ILD rating greater than 60. In one embodiment, the high density foam layer 30 has a thickness ranging from ½ inch to 1 inch, and in one preferred embodiment, a thickness of ¾ inch, whereby the quilt panel 12 has an uncompressed overall thickness of an inch.

Turning back to FIG. 2, in the illustrated embodiment, the head and foot sections 18, 20 of the quilt panel 12 and the high density foam layer 30 overlay and are in contact with a convoluted foam layer 32. In one embodiment, the high density foam layer 30 is glued to either the backing layer 24, the convoluted foam layer 32, or both. The convoluted foam layer 32 may have convolutions that are generally dome shaped and have the approximate dimensions of 1" diameter base and ½ " height, though other configurations and dimensions may be suitably employed. For example, a ripple pattern, or another self-complementary pattern, or a pair of different but complementary patterns, could alternatively be used instead of the illustrated egg -crate pattern. In one embodiment, the maximum thickness of the convoluted foam layer 32 is greater than the thickness of the high density foam layer 30. In one embodiment, the convoluted foam layer 32 has a base thickness of ½ inch, and an overall height of 1½ inches. In one embodiment, the convoluted foam later is an open-cell polyurethane foam of about 1 pound per cubic foot bulk density, and with an ILD rating of about 30. In other embodiments, the convoluted foam layer 32 has a density and ILD rating less than the high density foam layer 30.

In the illustrated embodiment, a non-woven fabric 34 may be applied to under the convoluted foam layer 32 and secured to a flange 36. The flange 36 at one end is stitched to binding tape or piping 38 at the edges of the mattress 10 and at the other is tied to spring elements 40 of an innerspring assembly 42 at the perimeter by hog rings 44 or other means. The innerspring assembly 42 includes a plurality of spring elements 40 held in an array by interconnection with crosswires 46 and at their terminal ends by lacing wires 48. The terminal ends of the spring elements 40 as well as the crosswires 46 are held in a common plane which defines opposed top and bottom supporting surfaces of the innerspring assembly 42 over which the quilt panel 12, the high density foam layer 30, the convoluted foam layer 32, and the non -woven fabric 34 are provided.

Although the quilt panel 12, the high density foam layer 30, and the convoluted foam layer 32 are provided to both top and bottom sides of the mattress 10, in other embodiments, such materials may be provided to only one side of the mattress 10. Furthermore, although the mattress 10 is depicted in FIG. 2 as generally symmetrical or identical sequences of layers of material over the innerspring assembly 42, it is understood that other arrangements and sequences of materials, including non-identical or non-symmetrical layers of material relative to the opposed sides of the mattress could be employed within the scope of the invention. Moreover, additional supporting surfaces, for example, woven, non-woven, and foam layers may be provided in and around the innerspring assembly 42 in still other embodiments.

By this arrangement, the quilt panel 12 and the high density foam layer 30 together form a quilted zoned topper 50 according to the present invention. The quilted zoned topper 50 provides a center section 14 which is of substantially greater density than the other compressible layers of material in the mattress 10, and being provided in a pocket 28 provides a level support height to the mattress 10. It is to be appreciated that although the quilted zoned topper 50 has been shown as a non-removable covering to an innerspring assembly, in other embodiments the quilted zoned topper 50 may be fitted to lay atop a mattress, or in still another embodiment may have an elasticized skirt to hold it removably in place over an existing mattress.

As will be recognized by those skilled in the art, the innovative concepts described in the present application can be modified and varied over a tremendous range of applications, and accordingly the scope of patented subject matter is not limited by any of the specific exemplary teachings given.

What is claimed is:

1. A quilted zoned topper comprising:

a quilted panel having a ticking material, a backing material, and a support material having a degree of compression provided between the ticking and backing materials, the ticking material, the support material and the backing material all being quilted together by a stitching pattern providing an increased amount of stitching in a center section of the quilted panel than adjacent head and foot sections of the quilted panel such that the support material pre-compresses in the center section thereby defining a pocket; and a memory foam provided in the pocket.

2. The quilted zoned topper of claim 1, wherein the ticking material comprises an upholstery ticking.

3. The quilted zoned topper of claim 1, wherein the backing material comprises a non-woven fabric.

4. The quilted zoned topper of claim 1, wherein the support material comprises a polymer foam or fill layer.

5. The quilted zoned topper of claim 1, wherein the center section ranges in size from about ¼ to about ½ of the total area of the quilted zoned topper.

6. The quilted zoned topper of claim 1, wherein the stitching pattern is selected from a star pattern, a circle pattern, a swoop pattern, a ribbon pattern, a 213 pattern, and a 301 pattern.

7. The quilted zoned topper of claim 1, wherein the memory foam is a polyurethane foam with a bulk density ranging from about 1.8 to about 4.0 pounds per cubic foot.

8. The quilted zoned topper of claim 1, wherein the memory foam has a thickness ranging from ½ inch to 1 inch.

9. The quilted zoned topper of claim 1, further comprising an elasticized skirt of material which is attached to the periphery of the topper.

10. A mattress comprising the quilted zoned topper of claim 1.

11. A mattress comprising:

an innerspring assembly having a plurality of spring elements and defining a support surface;

at least one convoluted foam layer positioned over the support surface of the innerspring assembly and having a first density, and a memory foam layer positioned over the convoluted foam layer opposite to the support surface, the memory foam layer having a density greater than the convoluted foam layer, and a quilted panel having a ticking material, a backing material, and a support material having a degree of compression provided between the ticking and backing materials, the ticking material, the support material and the backing material all being quilted together by a stitching pattern providing an increased amount of stitching in a center section of the quilted panel than adjacent head and foot sections of the quilted panel such that the support material pre-compresses in the center section thereby defining a pocket, wherein the quilted panel is provided over the convoluted and memory foam layers such that the memory foam layer is provided in the pocket.

12. The mattress of claim 11, wherein the convoluted foam layer has a bulk density of about 1 pound per cubic foot.

13. The mattress of claim 11, wherein the ticking material comprises an upholstery ticking.

14. The mattress of claim 11, wherein the backing material comprises a non-woven fabric.

15. The mattress of claim 11, wherein the support material comprises a polymer foam or fill layer.

16. The mattress of claim 11, wherein the center section ranges in size from about ¼ to about ½ of the total area of the mattress.

17. The mattress of claim 11, wherein the stitching pattern is selected from a star pattern, a circle pattern, a swoop pattern, a ribbon pattern, a 213 pattern, and a 301 pattern.

18. The mattress of claim 11, wherein the memory foam layer is a polyurethane foam with a bulk density ranging from about 2.6 to about 4.0 pounds per cubic foot.

19. The mattress of claim 11, wherein the memory foam layer has a thickness ranging from ½ inch to 1 inch.

20. The mattress of claim 11, wherein the convoluted foam layer has an egg-carton pattern.

* * * * *

UNITED STATES PATENT AND TRADEMARK OFFICE

CERTIFICATE OF CORRECTION

PATENT NO. : 7,886,385 B2
APPLICATION NO. : 12/468113
DATED : February 15, 2011
INVENTOR(S) : Carlitz It is certified that error appears in the above-identified patent and that said Letters Patent is hereby corrected as shown below:

Col. 4, Line 1, “convoluted foam later” should read as -- convoluted foam layer --

Signed and Sealed this
Twenty-third Day of August, 2011

David J. Kappos

David J. Kappos
*Director of the United States Patent and Trademark Office*